US007322914B1

(12) United States Patent
Vittone et al.

(10) Patent No.: US 7,322,914 B1
(45) Date of Patent: Jan. 29, 2008

(54) RANGE OF MOTION EXERCISE DEVICES

(76) Inventors: Suzanne R. Vittone, 5553 W. Center Dr., Hurley, WI (US) 54534; Larry W. Vittone, 5553 W. Center Dr., Hurley, WI (US) 54534; William M. Vittone, 127 Monticello Rd., Oak Ridge, TN (US) 37830

( * ) Notice: Subject to any disclaimer, the term of this patent is extended or adjusted under 35 U.S.C. 154(b) by 232 days.

(21) Appl. No.: 11/065,644

(22) Filed: Feb. 24, 2005

(51) Int. Cl.
*A63B 22/14* (2006.01)

(52) U.S. Cl. ..... 482/146

(58) Field of Classification Search ..... 482/23, 482/79–80, 146–147, 34, 119; 601/5
See application file for complete search history.

(56) References Cited

U.S. PATENT DOCUMENTS 4,605,220 A * 8/1986 Troxel ..... 482/79
4,707,934 A * 11/1987 Hart ..... 36/7.8
5,857,944 A * 1/1999 Cone et al. ..... 482/66
6,277,057 B1 * 8/2001 Hayden ..... 482/79
6,821,235 B1 * 11/2004 Johnson et al. ..... 482/79
7,192,410 B1 * 3/2007 Rodgers ..... 602/36

* cited by examiner

*Primary Examiner*—Lori Amerson
(74) *Attorney, Agent, or Firm*—Luedeka, Neely & Graham, P.C.

(57) ABSTRACT

Exercise devices which enable exercise through a substantially complete range of motion of a body part. The devices include a body contact member located adjacent a frame portion. A plurality of tension members extend between the frame portion and the body contact member to supply tension to yieldably resist motion of the body contact member relative to the frame portion.

9 Claims, 7 Drawing Sheets

RANGE OF MOTION EXERCISE DEVICES

FIELD OF THE INVENTION

This invention relates generally to exercise devices. More particularly, this invention relates to exercise devices which enable exercise through a substantially complete range of motion of a body part.

BACKGROUND AND SUMMARY OF THE INVENTION

In rehabilitating injuries, it is often desirable to move the injured body part through its available range of motion and to offer some resistance to such movement. For example, when rehabilitating an injured ankle, a physical therapist may hold the ankle of the injured person and ask the person to rotate or otherwise move the ankle in various directions as much as the person is able. The therapist will apply an appropriate amount of pressure to resist the movement corresponding to the condition of the person. As the rehabilitation progresses over time, the therapist will typically increase the resistance applied as the range of motion the person is able to achieve is increased. There is desired improvement in the availability of mechanical devices which enable a person to rehabilitate an injured ankle or other body part without the hands-on assistance of a physical therapist.

With regard to the foregoing, the present invention is directed to range of motion exercise devices. In a preferred embodiment, the devices include a body contact member configured for engageably receiving a body portion of a user and located adjacent a frame portion, and a plurality of tension members extending between the frame portion and the body contact member and configured to supply tension to yieldably resist motion of the body contact member relative to the frame portion during a range of motion exercise. The devices facilitate movement by a user through the range of motion that the user is able to achieve, while supplying an adjustable resistance to provide a desired amount of exercise.

In one aspect, the devices are configured for use with an ankle of a user. In another aspect, the devices are configured to exercise the neck of a user. As will be appreciated, however, the devices may be configured to exercise a wide variety of body parts including, but not limited to, arms, legs, and the abdomen.

Accordingly, in another embodiment, an exercise device is described which includes first and second exercise portions, each configured for exercising a body portion. The first and second exercise portions may be hingedly connected to facilitate shipping and storage.

BRIEF DESCRIPTION OF THE DRAWINGS

Further features of preferred embodiments of the invention will become apparent by reference to the detailed description of preferred embodiments when considered in conjunction with the figures, which are not to scale, wherein like reference numbers, indicate like elements through the several views, and wherein.

DETAILED DESCRIPTION

The invention relates to exercise devices which enable exercise through a substantially complete range of motion of body parts. The devices may be configured for use in exercising a variety of body parts. In this regard, in one embodiment of the invention an exercise device configured for exercising the ankle or a wrist of a user is described. In another embodiment, a neck exerciser is described. In another embodiment, an exerciser is described which facilitates exercise of the legs, knees, arms, or shoulder of a user.

In a preferred embodiment, such devices commonly include a body contact member located intermediate a frame portion and having a plurality of tension members extending between the frame portion and the body contact member which supply tension to resist motion of the body contact member relative to the frame portion. The devices are preferably configured so that the amount of tension supplied by the tension members may be adjusted. For example, in a preferred embodiment, the relative positions of the frame portion and the body contact member are preferably adjustable to enable adjustment of the tension of the tension members.

Figure 1:
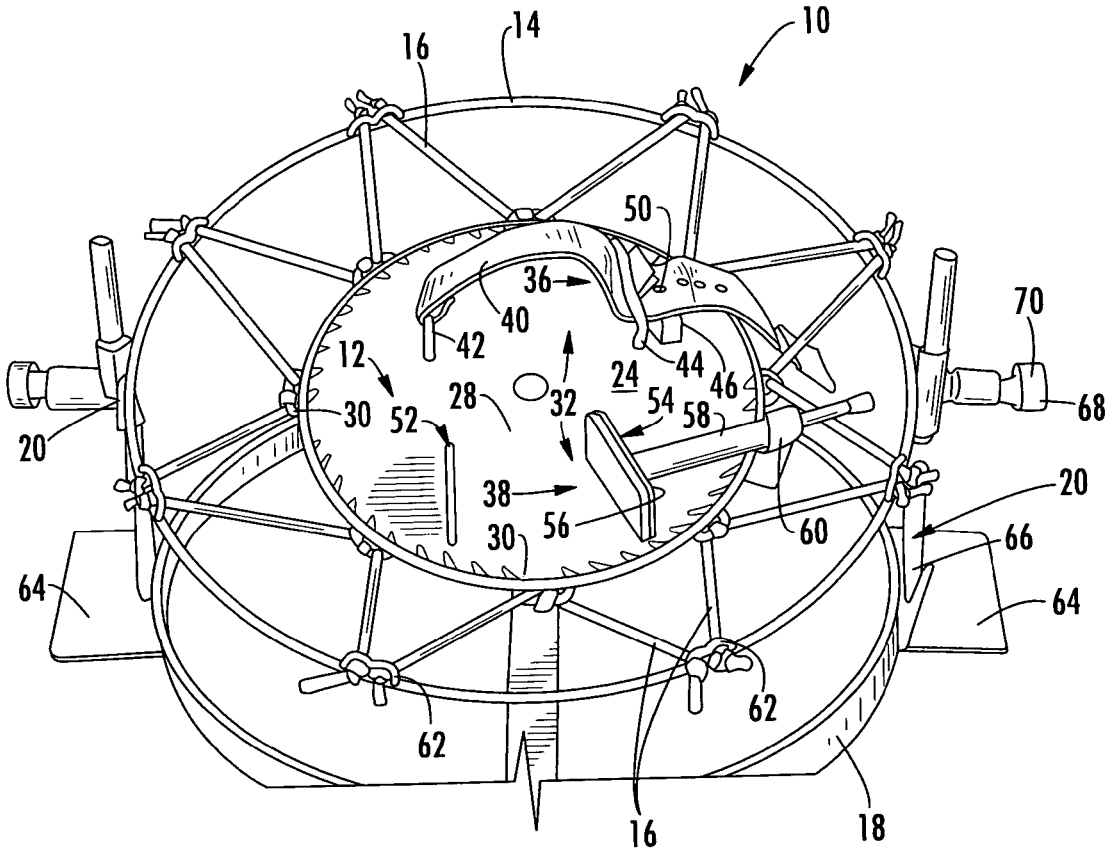
FIG. 1 is a perspective view of an ankle exerciser in accordance with a preferred embodiment of the invention.
Figure 2:
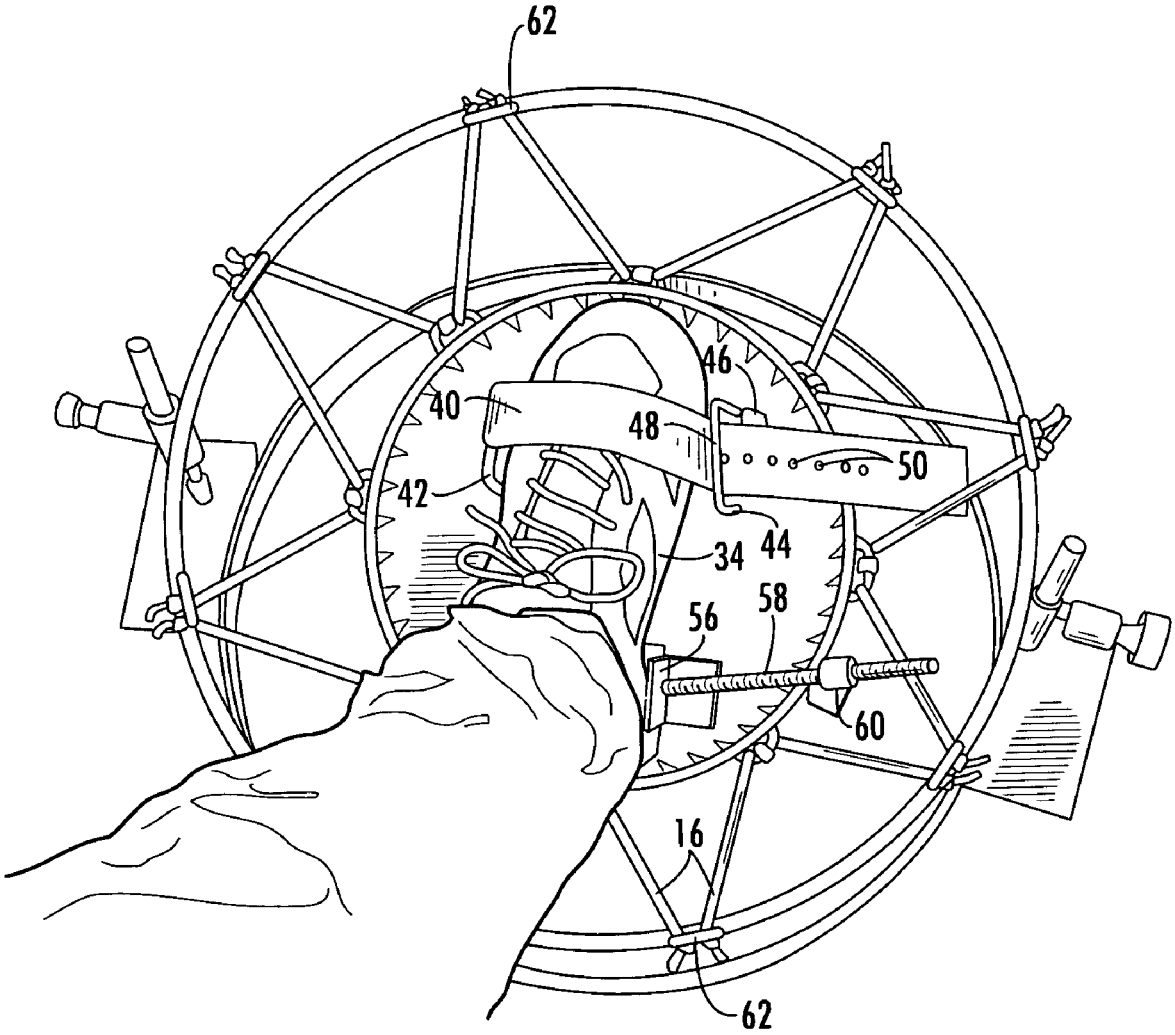
FIG. 2 shows a foot of a user positioned on the exerciser of FIG. 1.
Figure 3:
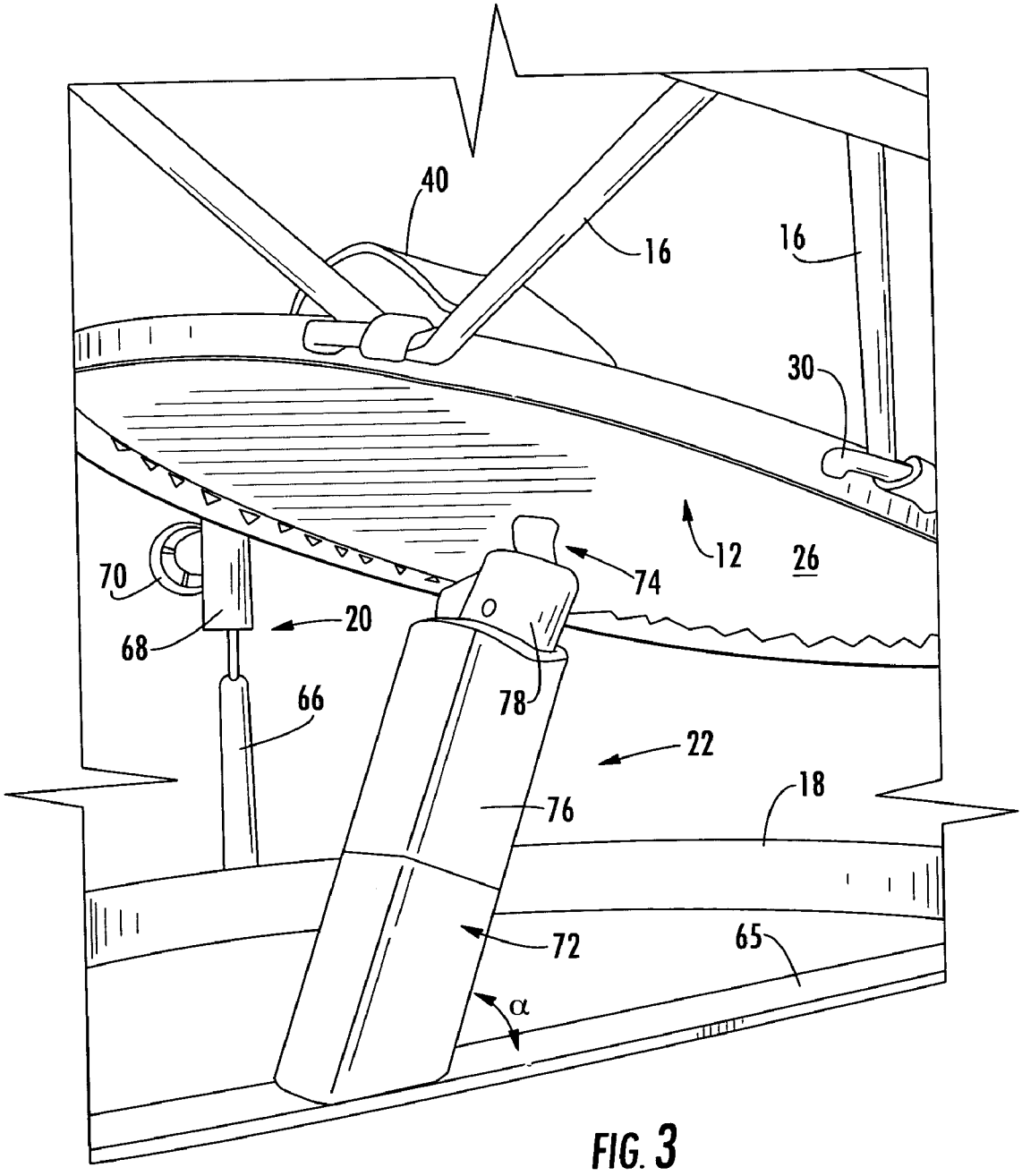
FIG. 3 is a close-up view of a pivot assembly structure of the exerciser of FIG. 1.

FIGS. 1-3 Ankle Exerciser

With initial reference to FIGS. 1-3, there is shown an ankle exerciser 10 having a body contact member 12 located intermediate a first frame portion 14 and having a plurality of tension members 16. The tension members 16 extend between the frame portion 14 and the body contact member 12 and supply tension to resist motion of the body contact member 12 relative to the frame portion 14. The ankle exerciser 10 also preferably includes a second frame portion 18, one or more frame supports 20, and a pivot assembly 22.

The body contact member 12 is preferably provided by a circular plate 24 made of a substantially rigid material such as metal or high impact plastic and having a lower surface 26 and an opposite upper surface 28. The plate 24 preferably has a diameter sufficient to receive the foot of a user, preferably a diameter of from about 14 to about 18 inches. A plurality of loops 30 or other connection structures are defined adjacent the perimeter of the plate 24 for connection of the tension members 16 to the plate 24. A foot securement system 32 is provided to secure foot or shoe 34 of a user adjacent the upper surface 28 of the body contact member 12.

The securement system 32 preferably includes a strap assembly 36 and a clamp 38. The strap assembly 36 cooperates with the front end of the foot of the user and the clamp 38 cooperates with the heel end of the foot. The strap assembly 36 preferably includes a strap 40, U-shaped members 42 and 44 connected to the upper surface 28, and buckle 46. One end of the strap 40 is secured to the U-shaped member 42 and the opposite end of the strap 40 is passed over the foot of the user and through the other U-shaped member for cooperating with the buckle 46 for adjusting the tension of the strap 40 over the foot as seen in FIG. 2. The buckle 46 preferably has a pivoting member 48 that may be placed through spaced apart apertures 50 defined on the strap 40.

The clamp 38 includes a static member 52 rigidly attached to the surface 28 of the plate 24 and a movable member 54 movably secured to the plate 24. The movable member 54 preferably includes a plate 56 connected to a threaded shaft 58 threadably received by a cylinder 60 having internal threads and fixedly connected to the plate 24. The heel of the foot of is placed against the static member 52 and the threaded shaft 58 rotated relative to the cylinder 60 to press the plate 56 against the opposite side of the heel, as seen in FIG. 2.

The first frame portion 14 is preferably a substantially continuous hoop made of a strong and rigid material such as metal or high impact plastic. The frame portion 14 is sized slightly larger than the plate 24 such that the tension members 16 span therebetween. For example, in the case of the plate having a diameter of 14 inches, the frame portion 14 may preferably be provided by a hoop having a diameter of from about 18 to 24 inches. The first frame portion 14 preferably includes a plurality of loops 62 thereon and uniformly spaced about the circumference for attachment of the tension members 16 to the frame portion 14.

The tension members 16 are preferably provided by lengths of elastic cording, but may also be provided by other elastic members such as springs. A preferred elastic cording material is latex rubber tubing. A particularly preferred rubber tubing is rubber tubing available under the name HI-START in diameters of 7/32 inch (6 mm) and 5/16 inch (8 mm) such as available from Dynaflite (www.dynaflite.com). The cording is provided in lengths sufficient to attach to and span between the loops 30 and 62. The plurality of tension members 16 may alternatively be provided by a single length of cording tied at the loops or otherwise configured to provide a substantially uniform tension throughout the range of motion of the user.

The tension members 16 are preferably substantially uniformly spaced apart from one another about the perimeter of the body contact member 12 and configured for uniformity of the tension supplied thereby around the perimeter. That is, each of the tension members 16 is preferably configured to supply substantially the same level of tension. Thus, a substantially uniform resistance is met by a user throughout the range of motion of the ankle during exercise.

The second frame portion 18 is preferably circular shaped and configured to provide a base to provide a stable support of the assembled exerciser 10 relative to the ground or other support surface. The second frame portion 18 may also preferably include extensions 64 to provide increased stability. The second frame portion 18 also preferably includes a cross member 65 to facilitate connection of the pivot assembly 22 to the second frame portion 18.

The frame supports 20 preferably extend between the first frame portion 14 and the second frame potion 18 to enable adjustment of the position of the first frame portion 14 relative to the body contact member 12. In a preferred embodiment, the frame supports 20 may include a rod 66 attached to the second frame portion 18, as by welding, and oriented to provide a vertical guide for travel of the first frame portion 14.

In this regard, the first frame portion 14 may include a cylinder 68 attached thereto for slidably receiving the rod 66. A threaded member 70 is preferably received through a correspondingly threaded aperture through the sidewall of the cylinder 68 for bearing against the rod 66. In this manner, the threaded member 70 may be utilized to lock the relative position of the cylinder 68 and the rod 66 to desirably fix the vertical relationship of the first frame portion 14 to the body contact member 12. To adjust the relative position, the threaded member 70 is unthreaded to permit the cylinder 68 to be moved along the length of the rod 66 to adjust the tension of the tension member 16. For example, raising the first frame portion 14 relative to the body contact member 12 increases the tension of the tension members 16.

With reference to FIG. 3, the pivot assembly 22 pivotally connects the body contact member 12 to the second frame portion 18. In a preferred embodiment, the pivot assembly 22 includes a base 72 and a pivot member 74. The base 72 is preferably provided by an elongate member 76 having a fixed or adjustable length and connected at one end to the cross member 65. The opposite end of the elongate member 76 is configured for receiving a ball socket 78. The elongate member 76 is preferably configured so that it extends upwardly from the cross member 65 at a fixed or adjustable angle $\alpha$ of from about 45 to about 75 degrees. Thus, the body contact member 12 is preferably angled toward the ground as best seen in FIG. 3. The pivot member 74 is preferably provided by a ball member having a rod attached thereto, with the ball member being received by the ball socket 78 in the manner of a ball joint, with the rod portion thereof extending away for being rigidly connected to the adjacent surface 26 of the plate 24 or other body contact member 12.

To use the exercise device 10, the foot of the user is secured to the body contact member 12 as by use of the securement system 32, with the height and angle of the body contact member 12 either being fixed or previously adjusted as desired. The ankle of the user may be rotated by manipulating the foot throughout the range of motion of the ankle. Tension provided by the tension members 16 resist movement by the user to provide exercise to the ankle for strength and rehabilitation purposes. For example, the user may rock the ankle from heel to toe, swivel the ankle from side to side, and rotate the ankle joint in a circular motion and experience substantially uniform resistance and freedom of movement through out the normal range of motion of the ankle of the user.

The height of the first frame portion 14 relative to the body contact member 12 may be adjusted by use of the frame supports 20 to vary the resistance imparted by the tension members 16. In addition, if the device 10 is configured to enable the height and angle of the body contact member 12 to be adjusted, these may also be adjusted to effect exercise.

Figure 4:
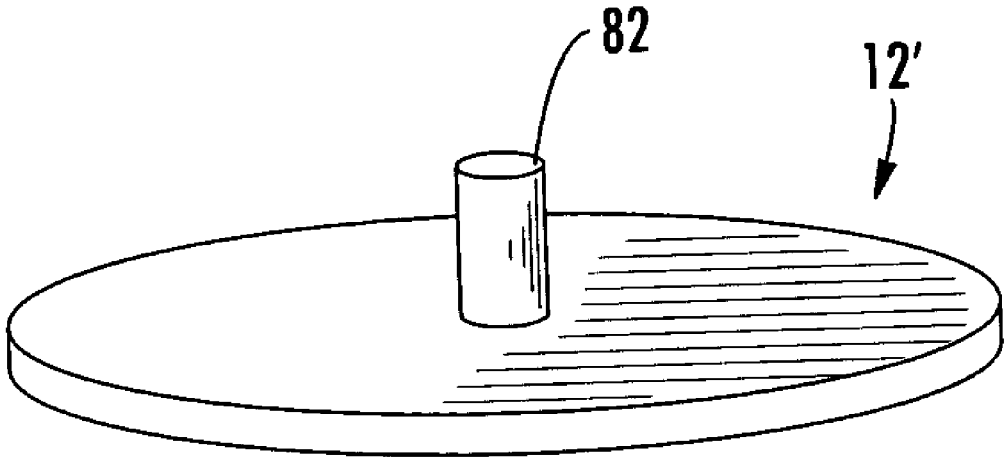
FIG. 4 shows an alternate embodiment of a body contact member for receiving the wrist of a user.

FIG. 4—Wrist Exerciser

With reference to FIG. 4, there is shown an alternate embodiment of a body contact member 12' that is substituted for the body contact member 12 in the device 10 described previously in connection with FIGS. 1-3. Substitution of the member 12' for the member 12 enables the device to be used for exercising the wrist. The body contact member 12' is preferably substantially similar to the member 12, except that instead of including the foot securement system 32, the upper surface is configured for cooperating with the hand of the user. Accordingly, in a preferred embodiment, the member 12' includes a rod 82 extending from the upper surface thereof for grasping by the hand of the user. The user may grasp the rod 82 to exercise the wrist of the user in a manner similar to that used to exercise the ankle.

Figure 5:
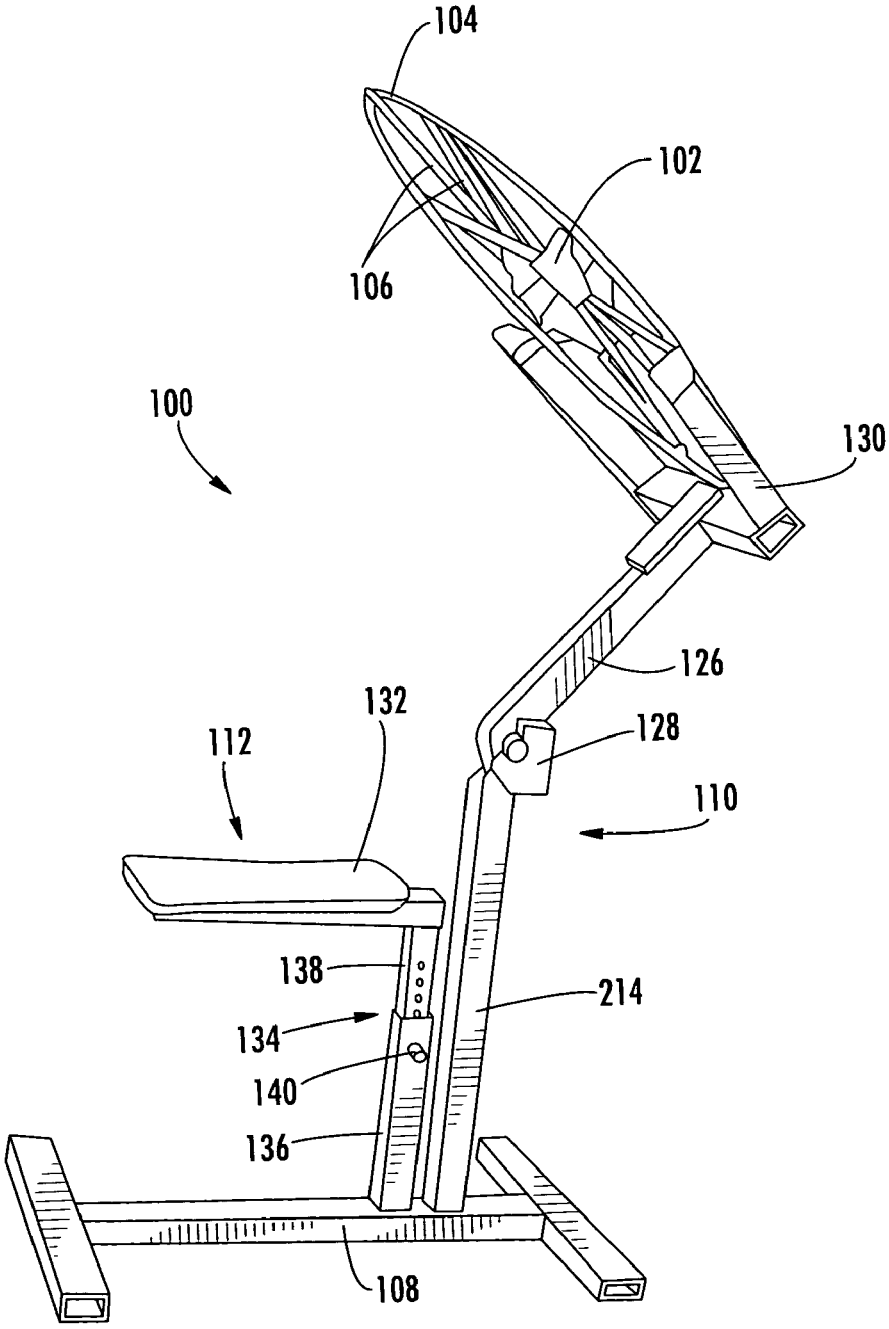
FIGS. 5 and 6 are perspective views of a neck exerciser in accordance with an alternate embodiment of the invention.
Figure 6:
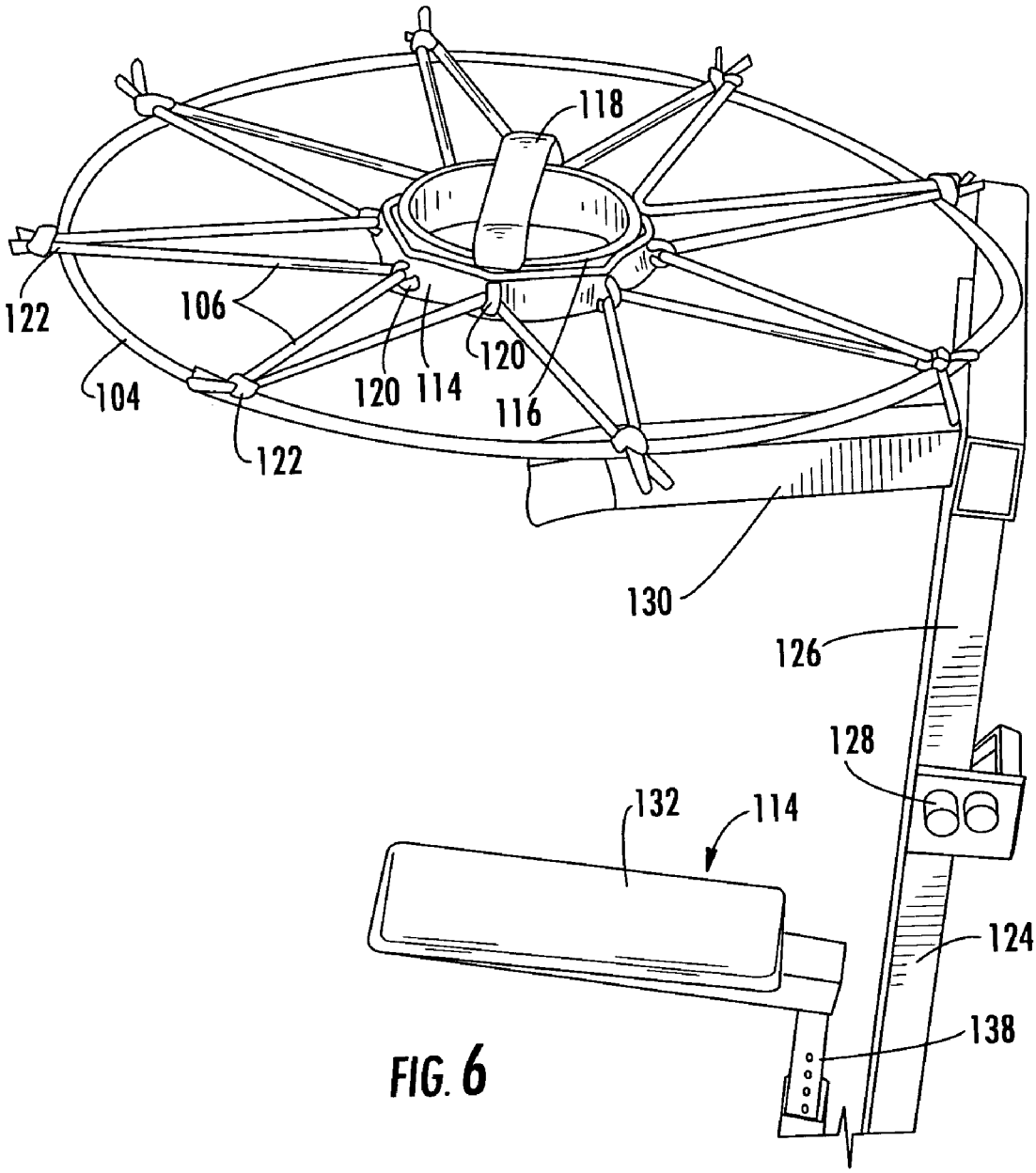

FIGS. 5-6 Neck Exerciser

With reference to FIGS. 5 and 6, there is shown a neck exerciser 100 having a body contact member 102 located intermediate a first frame portion 104 and having a plurality of tension members 106. The tension members 106 extend between the frame portion 104 and the body contact member 102 and supply tension to resist motion of the body contact member 102 relative to the frame portion 104. The neck exerciser 100 also preferably includes a second frame portion 108, a frame support 110, and a seat assembly 112.

The body contact member 102 is preferably provided by a ring 114 preferably made of a flexible and conforming material such as leather or nylon belting or the like and having padding 116 disposed about its inner sidewall and an overlying strap 118 to limit passage of the head of the user. The material of the ring 114 is preferably sturdy enough to retain the ring shape, but conforms to the head of the user. The ring 114 preferably has a diameter sufficient to receive an upper portion of the cranium of a user. A plurality of loops 120 or other connection structures are defined adjacent the perimeter of the ring 114 for connection of the tension members 106 to the ring 114.

The first frame portion 104 is preferably a substantially continuous hoop made of a strong and rigid material such as metal or high impact plastic. The frame portion 104 is sized larger than the ring 114 such that the tension members 106 span therebetween. The first frame portion 104 preferably includes a plurality of loops 122 thereon and uniformly spaced about the circumference for attachment of the tension members 106 to the frame portion 104.

The tension members 106 are preferably provided by lengths of elastic cording, but may also be provided by other elastic members such as springs, as described previously for the tension members 16. The cording is provided in lengths sufficient to attach to and span between the loops 120 and 122. The tension members 106 are preferably substantially uniformly spaced apart from one another about the perimeter of the body contact member 102 and configured for uniformity of the tension supplied thereby around the perimeter. This advantageously enable a substantially uniform resistance is met by a user throughout the range of motion of the neck during exercise.

The second frame portion 108 is configured to provide a base to provide a stable support of the assembled exerciser 100 relative to the ground or other support surface. For example, in a preferred embodiment, the second frame portion 108 is substantially I-shaped.

The frame support 110 preferably extends between the first frame portion 104 and the second frame potion 108 to enable adjustment of the position of the first frame portion 104, and hence the body contact member 12, relative to a user. In a preferred embodiment, the frame support 110 may include a pair of elongate members 124 and 126 hingedly connected in an end-to-end relationship by a hinge 128, and a U-shaped member 130 interfacing between the elongate member 126 and the first frame portion 104. The elongate members 124 and 126 may be of fixed or adjustable length. The elongate member 124 is preferably rigidly connected to the second frame portion 108, as by welding, and extends upwardly therefrom. The hinge 128 permits the relative pivotal movement of the elongate member 126 relative to the elongate member 124, such as between the positions shown in FIGS. 4 and 5. The hinge 128 also preferably includes a lock, such as a pin or other securement structure, that enables the relative positions of the elongate members 124 and 126 to be fixed if desired.

The seat assembly 112 preferably includes a seat 132 mounted to an adjustable seat support 134 connected to the second frame portion 108. The seat support 134 may be provided by a conduit 136 connected to and extending from the frame portion 108, and a telescoping member 138 telescopically received by the conduit 136. A pin 140 or the like may be used to lock the relative positions of the telescoping member 138 and the conduit 136 to adjust the height of the seat 132.

To use the exercise device 100, the device is oriented as shown in FIG. 4 by use of the hinge 128 and the user is seated upon the seat 132. The user then returns the device to the orientation shown in FIG. 5 such that the elongate members 124 and 126 is aligned and the ring 114 is substantially adjacent the upper portion of the cranium of the user. The user then adjusts the height of the seat 132 to press the cranium against the ring 114. The neck of the user may be moved throughout the range of motion of the neck. Tension provided by the tension members 106 resist movement by the user to provide exercise to the neck for strength and rehabilitation purposes. For example, the user may rock the neck forward and rearward, side to side, and in partial rotational movements and experience substantially uniform resistance and freedom of movement through out the normal range of motion of the neck of the user.

The height of the seat may be adjusted to vary the resistance imparted by the tension members 106. For example, the seat may be lowered to reduce tension and raised to increase tension. In addition, if the device 100 is configured with the elongate members 124 and 126 having adjustable length, the tension may be adjusted by varying the length of such members. Also, the angle of the ring 114 relative to the user may be adjusted via the hinge 128 to effect exercise.

Figure 7:
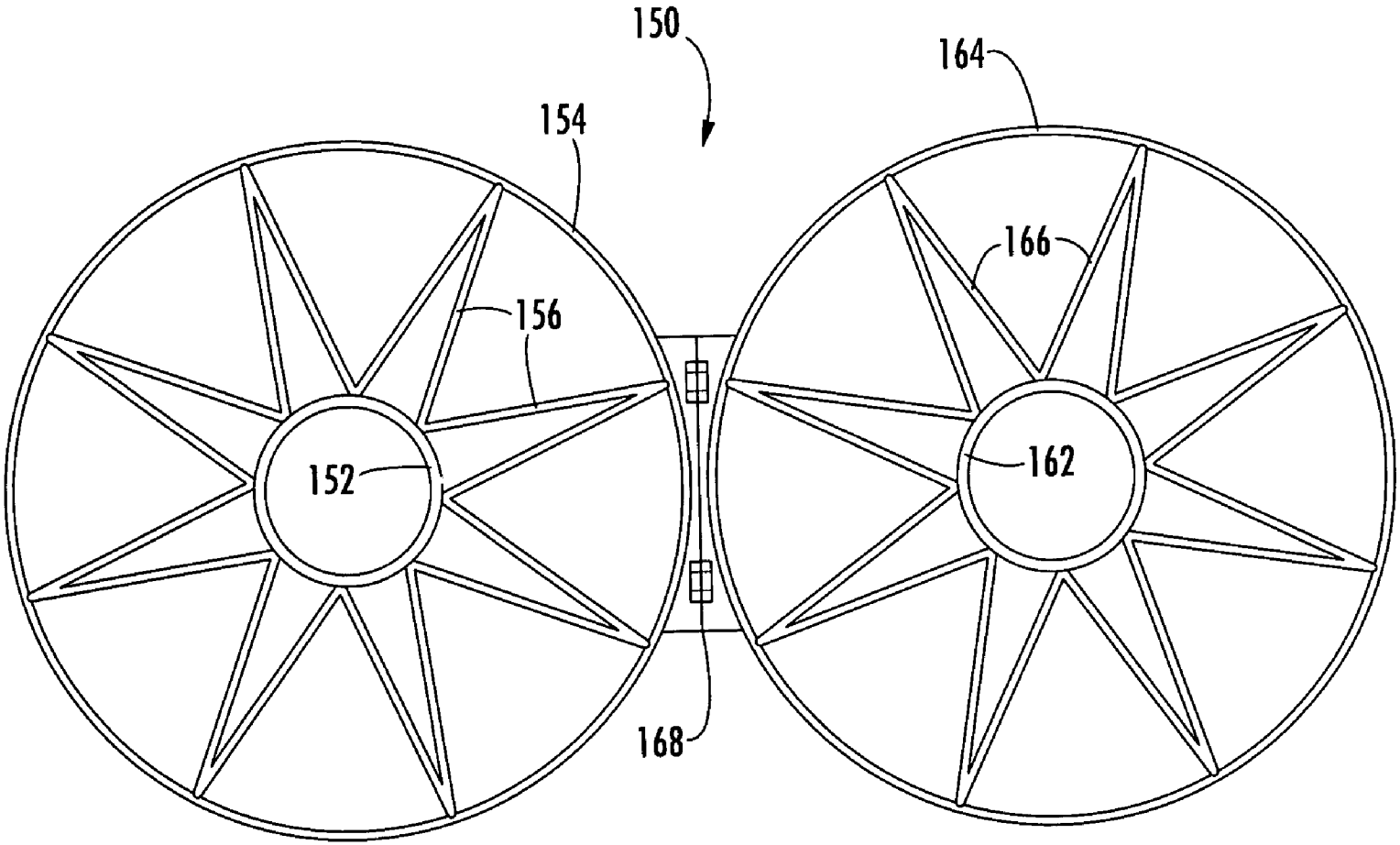
FIG. 7 shows an alternate embodiment of an exercise device configured for simultaneously exercising separate body portions.

FIG. 7—Leg and Arm Exerciser

With reference now to FIG. 7, there is shown an exerciser 150 having a first body contact member 152 located intermediate a first frame portion 154 and having a plurality of tension members 156, and a second body contact member 162 located intermediate a second frame portion 164 and having a plurality of tension members 166. The device 150 is configured for exercising the arms or the legs of a user as configured. However, if desired, a base, clamps, or other support structure may be provided for supporting the device 150 horizontally relative to the floor or vertically relative a wall surface to facilitate the desired exercise position.

The first frame portion 154 and the second frame portion 164 are preferably hingedly connected to one another as by hinge 168 so that the exerciser 150 may be folded for compact shipping and storage. The frame portions 154 and 164 and the tension members 156 and 166 preferably correspond to the frame portions 104 and tension members 106 described previously in connection with FIGS. 5 and 6.

The body contact members 152 and 154 are preferably configured similar to the body contact member 102 (except not including the strap 118) and receive the leg or knee or arm or elbow of the user. For example, the user may position the knees (or legs) within the members 152 and 154 and accomplish exercise motions to push the knees toward one another or apart from one another and in various other motions corresponding to the range of motion of the user. In a similar manner, the use may exercise arms and shoulders.

The tension members 156 extend between the frame portion 154 and the body contact member 152 and supply tension to resist motion of the body contact member 152 relative to the frame portion 154. Likewise, the tension members 166 extend between the frame portion 164 and the body contact member 162 and supply tension to resist motion of the body contact member 162 relative to the frame portion 164.

The foregoing description of certain exemplary embodiments of the present invention has been provided for purposes of illustration only, and it is understood that numerous modifications or alterations may be made in and to the illustrated embodiments without departing from the spirit and scope of the invention as defined in the following claims.

What is claimed is:

1. A range of motion ankle exercise device, comprising a body contact member configured for engageably receiving a foot of a user and located adjacent a first frame portion comprising a hoop, a plurality of tension members extending between the first frame portion and the body contact member and configured to supply tension to yieldably resist motion of the body contact member relative to the first frame portion during a range of motion exercise, a second frame portion, one or more frame supports extending between the first and second frame portions and configured to permit the first frame portion to be adjustably positioned relative to the second frame portion, and a pivot assembly pivotally connecting the body contact member to the second frame portion.

2. The device of claim 1, wherein the pivot assembly comprises a pivot member rigidly connected to the first frame portion and pivotally connected to the second frame portion.

3. A range of motion neck exercise device, comprising a body contact member configured for engageably receiving a cranium of a user and located adjacent a first frame portion, a plurality of tension members extending between the first frame portion and the body contact member and configured to supply tension to yieldably resist motion of the body contact member relative to the frame portion during a range of motion exercise, a second frame portion, a frame support extending between the first and second frame portions and configured to permit the first frame portion to be adjustably positioned relative to the second frame portion; and a seat assembly positioned to enable the user to sit upon the seat assembly and engage the cranium of the user with the body contact member.

4. The device of claim 3, wherein the body contact member comprises a ring.

5. The device of claim 3, wherein the first frame portion comprises a hoop.

6. The device of claim 3, wherein the frame support includes a hinge to enable the first frame portion to be pivoted relative to the second frame portion.

7. The device of claim 3, wherein the seat assembly comprises a seat adjustably positionable relative to the second frame portion.

8. A range of motion exercise device, comprising a first exercise system including a first body contact member configured for engageably receiving a first body portion of a user and located adjacent a first frame portion, a plurality of first tension members extending between the first frame portion and the first body contact member and configured to supply tension to yieldably resist motion of the first body contact member relative to the first frame portion during a range of motion exercise; and a second body contact member configured for engageably receiving a second body portion of a user and located adjacent a second frame portion, a plurality of second tension members extending between the second frame portion and the second body contact member and configured to supply tension to yieldably resist motion of the second body contact member relative to the second frame portion during a range of motion exercise.

9. The device of claim 8, wherein the first and second frame portions are hingedly connected to one another.

* * * * *